US006650847B2

(12) United States Patent
Guy et al.

(10) Patent No.: US 6,650,847 B2
(45) Date of Patent: Nov. 18, 2003

(54) CONTAINER FIGURATION MATCHING SYSTEM AND METHOD

(75) Inventors: Bernard L. Guy, Rochester, NY (US); Daniel A. Chiesa, Webster, NY (US)

(73) Assignee: Xerox Corporation, Stamford, CT (US)

( * ) Notice: Subject to any disclaimer, the term of this patent is extended or adjusted under 35 U.S.C. 154(b) by 124 days.

(21) Appl. No.: 10/024,728

(22) Filed: Dec. 21, 2001

(65) Prior Publication Data

US 2003/0118355 A1 Jun. 26, 2003

(51) Int. Cl.[7] ..... G03G 15/00
(52) U.S. Cl. ..... 399/12; 399/13
(58) Field of Search ..... 399/12, 13, 90

(56) References Cited

U.S. PATENT DOCUMENTS

| | | | | | |
|---|---|---|---|---|---|
| 4,650,070 | A | | 3/1987 | Oka et al. | 206/216 |
| 5,074,344 | A | | 12/1991 | Vacek et al. | 141/363 |
| 5,075,724 | A | * | 12/1991 | Wada et al. | 399/12 |
| 5,089,854 | A | | 2/1992 | Kaieda et al. | 355/260 |
| 5,091,750 | A | | 2/1992 | Yoshida et al. | 355/260 |
| 5,150,807 | A | | 9/1992 | Seyfried et al. | 220/359 |
| 5,331,382 | A | | 7/1994 | Miura et al. | 355/260 |
| 5,383,502 | A | | 1/1995 | Fisk et al. | 141/364 |
| 5,510,884 | A | * | 4/1996 | Bov, Jr. et al. | 399/90 X |
| 5,559,589 | A | | 9/1996 | Eichberger et al. | 355/260 |
| 5,576,816 | A | | 11/1996 | Staudt et al. | 355/260 |
| 5,613,177 | A | | 3/1997 | Meetze, Jr. et al. | 399/263 |
| 5,615,001 | A | | 3/1997 | Kawashima et al. | 399/226 |
| 5,630,198 | A | | 5/1997 | Makino | 399/120 |
| 5,648,838 | A | | 7/1997 | Michlin et al. | 399/119 |
| 5,655,181 | A | | 8/1997 | Chadani et al. | 399/114 |
| 5,678,121 | A | | 10/1997 | Meetze, Jr. et al. | 399/12 |
| 5,734,953 | A | | 3/1998 | Tatsumi | 399/262 |
| 5,761,566 | A | * | 6/1998 | Suzuki et al. | 399/12 |
| 5,812,915 | A | | 9/1998 | Farkash | 399/262 |
| 5,848,338 | A | | 12/1998 | Okada | 399/262 |
| 5,857,129 | A | | 1/1999 | Harris | 399/12 |
| 5,881,341 | A | | 3/1999 | Kumar et al. | 399/111 |
| 6,104,888 | A | * | 8/2000 | Kobayashi | 399/12 |
| 6,236,826 | B1 | | 5/2001 | Kurz et al. | 399/258 |
| 6,249,654 | B1 | | 6/2001 | Kurz et al. | 399/12 |
| 6,263,170 | B1 | * | 7/2001 | Bortnem | 399/13 |
| 6,266,506 | B1 | | 7/2001 | Kurz et al. | 399/262 |
| 6,269,234 | B1 | | 7/2001 | Kurz et al. | 399/258 |
| 6,529,691 | B2 | * | 3/2003 | Guy et al. | 399/12 |

OTHER PUBLICATIONS

U.S. Application No. 09/732,945, filed Dec. 8, 2000, Toner Cartridge Electrical Identification Mechanism, by Bernard L. Guy and Daniel A. Chiesa, commonly owned.

* cited by examiner

*Primary Examiner*—Fred L Braun
(74) *Attorney, Agent, or Firm*—Andrew D Ryan

(57) ABSTRACT

A container is provided for delivering a supply of particles for use in a developer unit of an electrophotographic apparatus. A resistor member, is permanently associated with the container. When the container is associated with the electrophotographic apparatus, the resistance of the resistor member is identified and a fault signal is communicated to a display when the incorrect configuration of the container is identified as being used in the electrophotographic apparatus. Also provided is a method of determining the configuration of a container in a printing or copying apparatus.

20 Claims, 8 Drawing Sheets

CONTAINER FIGURATION MATCHING SYSTEM AND METHOD

BACKGROUND OF THE INVENTION

This invention relates to an electrophotographic apparatus and, more particularly, to a part such as a container having a resistive member of selected resistance permanently associated therewith that may be associated with a sensor system adapted for identifying whether a container of the correct configuration is being used.

Reference is made to pending U.S. patent application Ser. No. 09/732,945, filed Dec. 8, 2000, Toner Cartridge Electrical Identification Mechanism, by Bernard L. Guy and Daniel A. Chiesa, commonly owned.

Examples of development systems, CRU's, and container systems can be found in U.S. Pat. Nos. 4,650,070; 5,074,344; 5,089,854; 5,091,750; 5,150,807; 5,331,382; 5,383,502; 5,559,589; 5,576,816; 5,613,177; 5,615,001; 5,648,838; 5,655,181; 5,630,198; 5,678,121; 5,734,953; 5,812,915; 5,848,338; 5,857,129; 5,881,341; 6,236,826; 6,249,654; 6,266,506; and 6,269,234.

All documents cited herein, including the foregoing, are incorporated herein in their entireties for all purposes.

SUMMARY OF THE INVENTION

In embodiments, there is provided a container for containing a supply of toner particles including a plastic body and a resistor member. The plastic body defines a wall, an outside surface, and a chamber. The chamber is for storing particles therein. The body is made of a first material. The resistor member has a length, width, thickness, and selected resistance value and is attached to the body. The resistor member is made of a second material and is permanently attached to the body. The resistor member is made of an electrically conductive material and is made of a material different than the body.

In embodiments, there is provided an electrophotographic apparatus including a process cartridge and a developing unit. The process cartridge includes a wall, an outside surface, and a chamber. The chamber is for storing particles therein. The developing unit including a spring member associated therewith which is adapted to move from a first position when the process cartridge is operatively engaged and close an electrical circuit of a voltage line and adapted to move to a second position when the process cartridge is removed and open the electrical circuit. In the second position, the open electrical circuit on the voltage line eliminates the high voltage power supply to the electrophotographic apparatus.

In embodiments, there is provided a method of determining the configuration of a container in a printing or copying apparatus comprising: providing a plastic container adapted for use in a developer unit, the container defining a wall, an outside surface, and a chamber; associating a resistor member with the plastic container, the resistor member having a length, width, thickness, and selected resistance value, the resistor member being made of an electrically conductive material; providing a sensor system and an electrical circuit adapted to identify a resistance value of the resistor member on the container when the resistor member is functionally associated with the electrical circuit; contacting the resistor member with the electrical circuit in conjunction with the container being functionally associated with a developer unit; identifying the resistance of the resistor member; and communicating a fault signal when a container of incorrect configuration is associated with the developer unit, the signal being triggered based on the identified resistance of the resistor member being outside an allowed target range programmed in a window comparator circuit.

Still other aspects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with CRU's, electrophotographic reproduction machines, electrostatographic apparatus, xerographic apparatus, printing and/or copying machines, it should be understood that the present invention is not limited to that embodiment or to that application. Therefore, it should be understood that the principles of the present invention and embodiments extend to all alternatives, modifications, and equivalents thereof.

Figure 1:
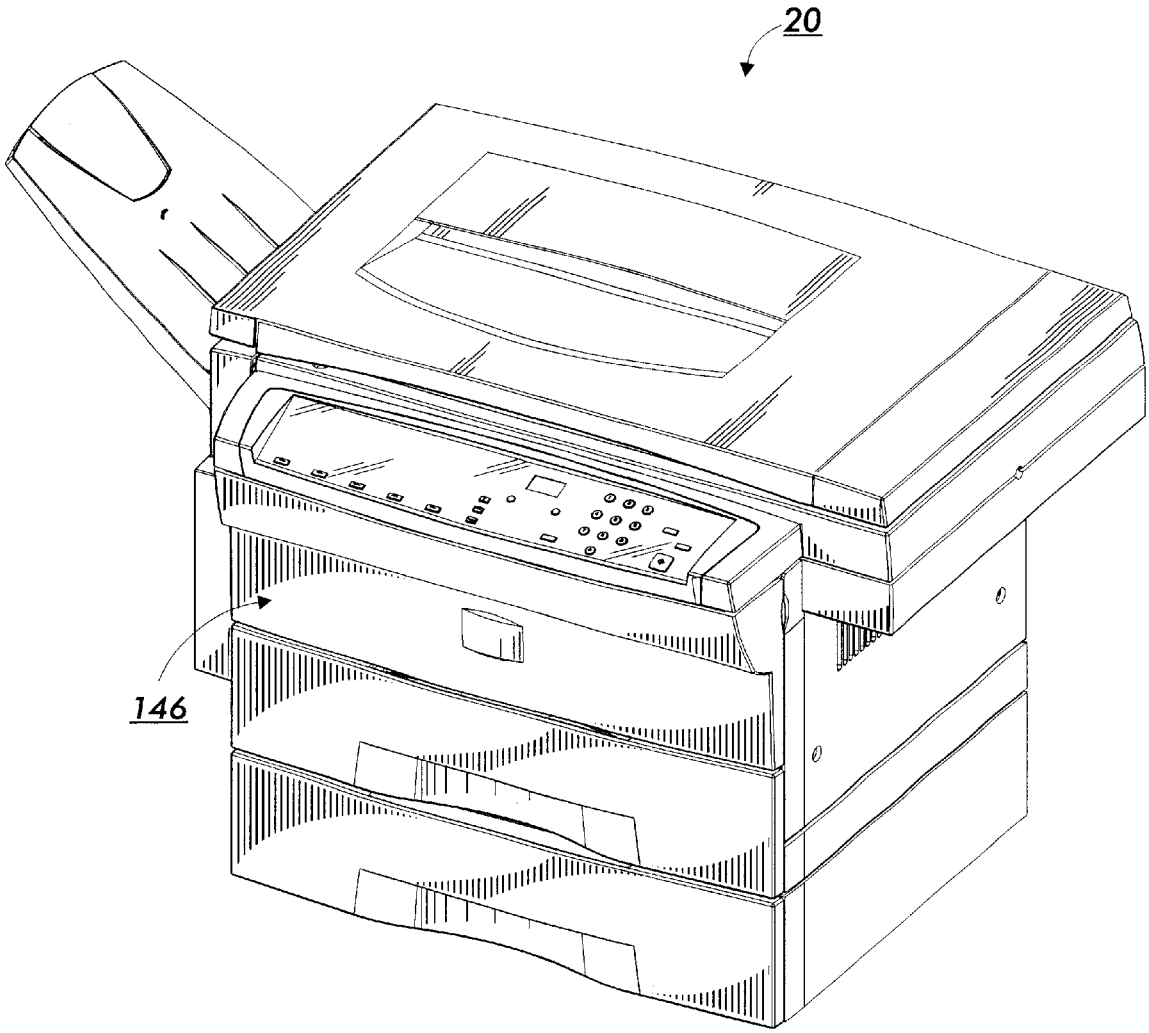
FIG. 1 is a perspective view of an exemplary electrophotographic apparatus.
Figure 2:
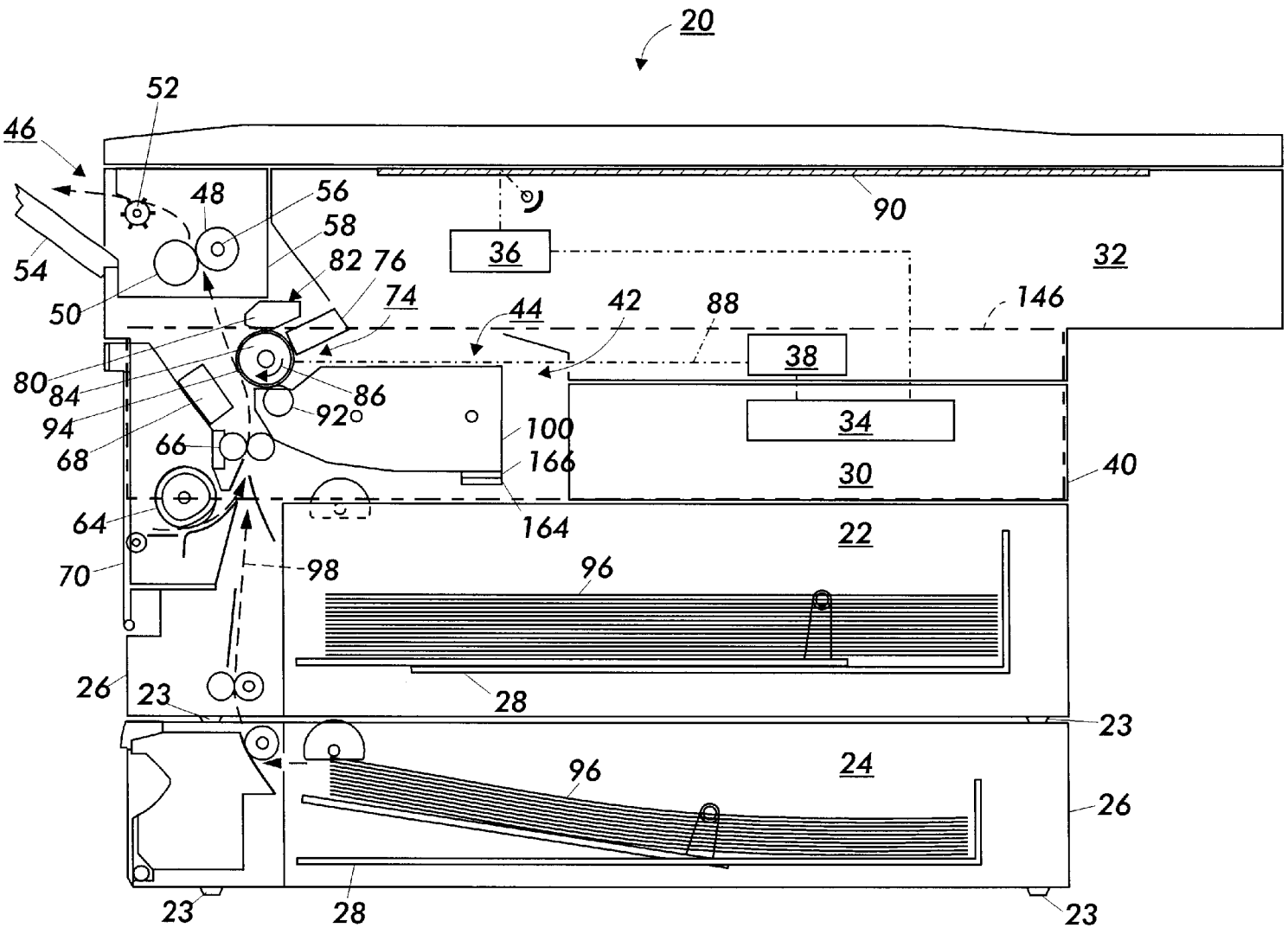
FIG. 2 is an elevational view of an exemplary electrophotographic apparatus.

FIGS. 1 and 2 illustrate a frameless exemplary electrophotographic reproduction machine 20 including separately framed mutually aligning modules. As shown in FIG. 2, the machine 20 may include a framed copy sheet input module (CIM) 22. Preferably, the machine 20 includes a pair of copy sheet input modules, a main or primary module the (CIM) 22, and an auxiliary module (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When the machine 20 includes two copy sheet input modules, the very base module is considered the auxiliary module (the ACIM), and the top module which mounts and mutually aligns against the base module is considered the primary module (the CIM).

The machine 20 includes a framed electronic control and power supply (ECS/PS) module 30, that as shown mounts onto, and is mutually aligned against the CIM 22. A framed latent image forming imager module 32 then mounts over and is mutually aligned against the ECS/PS module 30. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. The ECS/PS module 30 may include a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, define a cavity 42. The machine 20 may include a process cartridge module 44 that is insertably and removably mounted within the cavity 42, and in which it is mutually aligned with, and operatively connected to, the framed CIM, ECS/PS and imager modules 22, 30, 32.

As further shown, the machine 20 may include a framed fuser module 46, that is mounted above the process cartridge module 44, as well as adjacent an end of the imager module 32. The fuser module 46 includes a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine 20 may include active components including a bypass feeder assembly 64, sheet registration rolls 66, toner image transfer and detack devices 68, and the fused image output or exit tray 54. The machine 20 may include drive coupling components and electrical connectors (not shown), and a module frame 70 to which the active components are mounted, and which forms a covered portion of the machine 20, as well as, locates, mutually aligns, and mounts to adjacent framed modules, such as the CIM 22, the process cartridge module 44, and the fuser module 46.

The process cartridge module 44 may optionally include a photoreceptor subassembly 74, a charging subassembly 76, developer housing 100 including a source of fresh developer material, a cleaning subassembly 80 for removing residual toner as waste toner from a surface of the photoreceptor, and a waste toner sump subassembly 82 for storing waste toner. The process cartridge module 44 importantly provides and includes supporting, locating and aligning structures, as well as driving components for the process cartridge module 44.

The operation of an imaging cycle of the machine 20 using the process cartridge module 44 generally, can be briefly described as follows. Initially, a photoreceptor in the form of a photoconductive drum 84 of the process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer housing 100 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 24 along a copy sheet or substrate path 98. In this case, the detack device 68 of the door module (not shown) is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The process cartridge module 44 includes a developer housing 100. The machine 20 includes a cover 146 for providing access to the CRU cavity 42 when opened and to provide protection from dust and to prevent inadvertent access to the internal workings of the machine 20. The cover 146 may, for example, be in the form of a removable cover or in the form of a portion of a drawer which may be slid outwardly from the machine 20.

Figure 3:
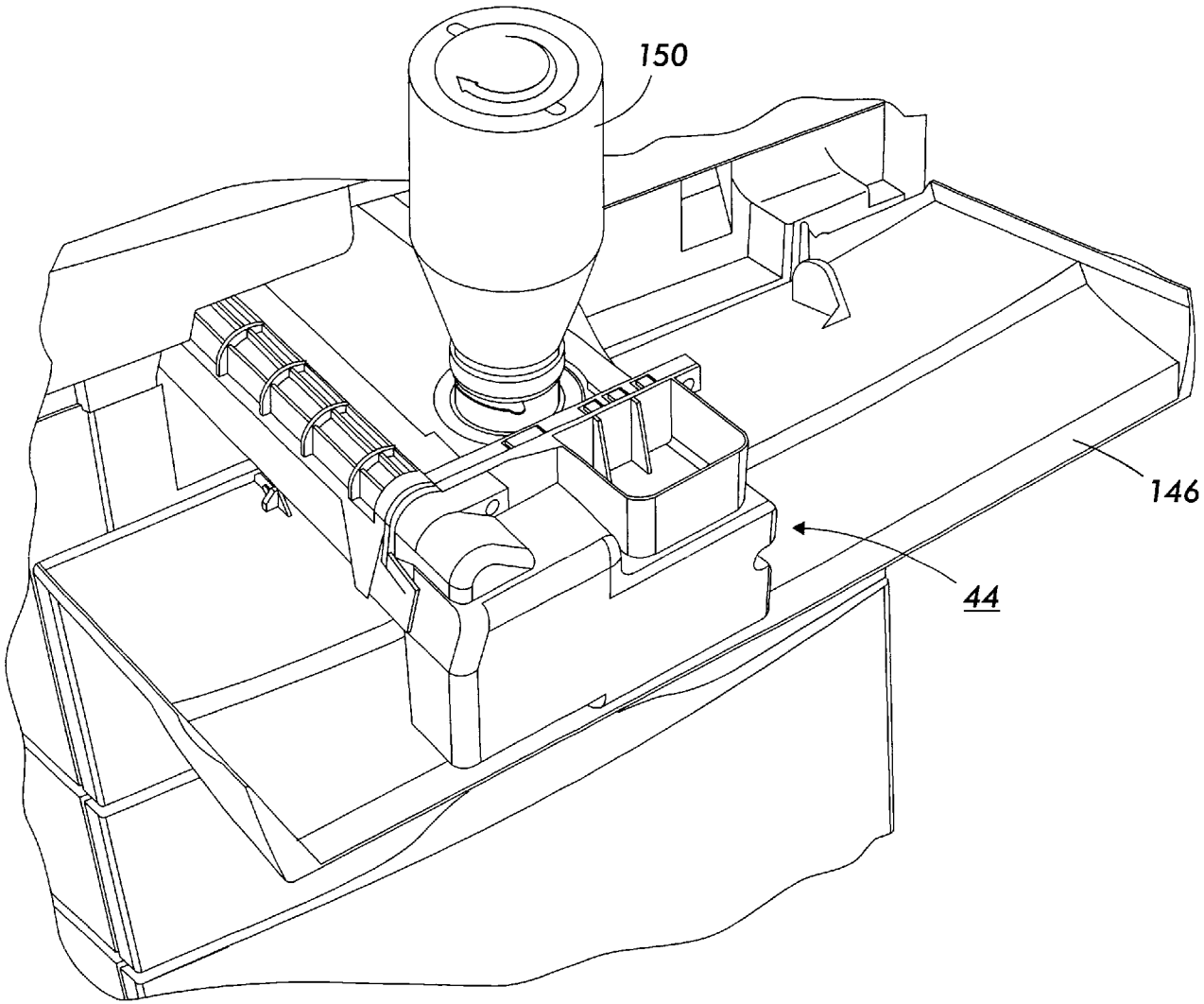
FIG. 3 is a perspective view illustrating a refillable process cartridge.

Turning now to FIG. 3, there is illustrated the process cartridge module or Customer Replaceable Unit (CRU) 44 indicating the CRU 44 in the reload position in the machine 20. The access cover 146 of the machine is shown in the open position and the CRU 44 is shown extended to the refill position with the toner bottle 150 inserted to refill toner into the CRU 44. Once the bottle 150 has been emptied, it is twisted and removed and the CRU 44 is inserted back into the machine 20 and the cover 146 closed to allow the machine to be in the operative mode.

Figure 4:
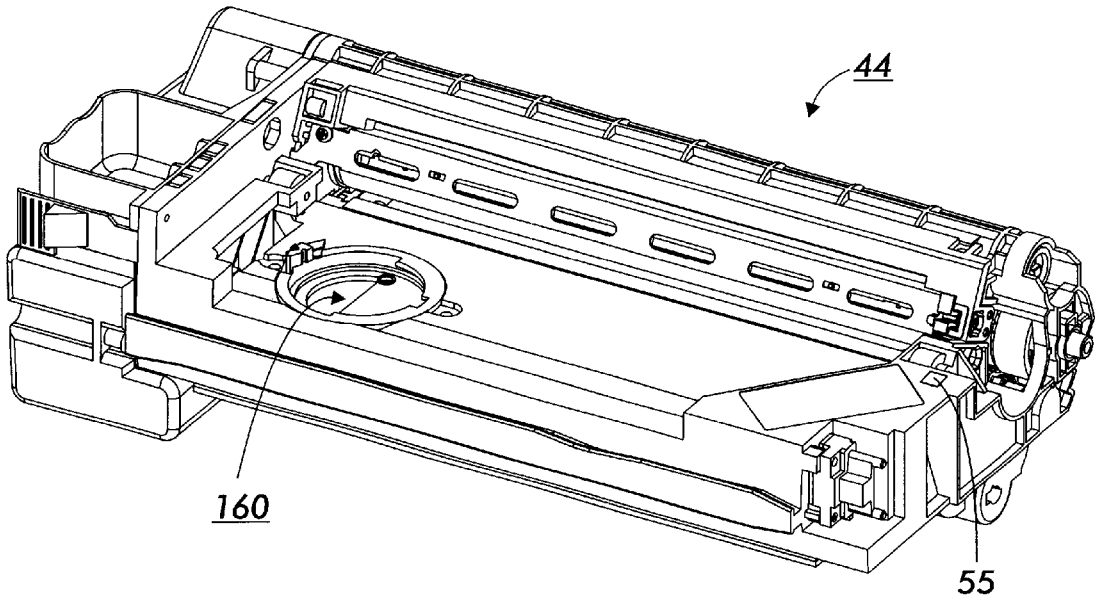
FIG. 4 is a top perspective view of a process cartridge of FIG. 3 with a toner bottle removed from the process cartridge.

FIG. 4 illustrates the CRU 44, without the toner bottle 150 fitted in the opening 160. A resistor member 55 is associated with the CRU 44 and is used to contact and conductively communicate with an electrical circuit and a sensor system in the electrophotographic apparatus.

Figure 5:
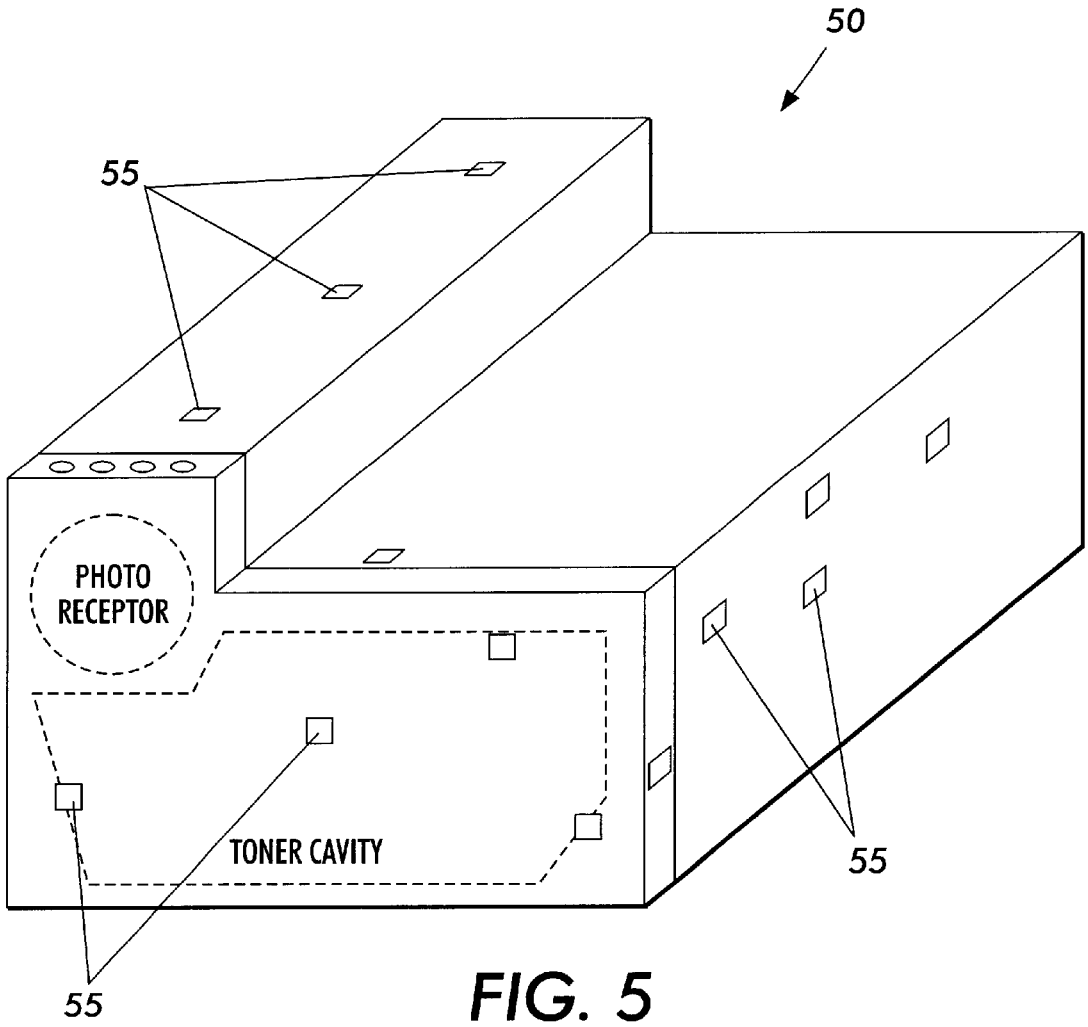
FIG. 5 is a perspective view of a process cartridge including indications of example location(s) for a resistor member.

FIG. 5 illustrates a perspective embodiment of a CRU 50 such as a process cartridge. Other CRU's such as toner bottles, other containers, and consumable parts are also envisioned to use resistor members and sensor systems for configuration matching. The CRU 50 includes various components such as a drive mechanism, photoreceptor, magnet roll, toner agitator, and electrical contacts such as a ground, developer bias, grid voltage, and pin current which may be located as necessary in the process cartridge depending on the system architecture requirements. Electrical connections may be located as required by system architecture requirements.

In embodiments, the body of the CRU may be made of a nonconductive plastic. A resistor member 55 can be located most anywhere on or in the CRU 50 and representative location(s) are shown on the outside surface of the CRU 50. A location of the resistive member 55 is restricted only by paper path, light path, and system architecture requirements. In embodiments, CRU may have one resistor member although more than one resistor member associated with the CRU is envisioned if additional digit codes are desired. Additional digit codes may be used for identifying informational subsets of a particular CRU type, for example, color.

In embodiments, the resistor member may be located on the surface, be embedded in the wall, or be located on a surface or wall internal to the CRU. The resistor member may be embedded in the body with contacts extending from the surface, or the resistor member may be a surface mount resistor. The resistor member may be located within a cavity of the CRU and include internal or external electrical contacts. The resistor member may be fixed on the outside of the CRU. The resistor member is sufficiently sized to fit on or in a portion of the CRU and may include various shapes sufficient to make physical contact including circular, square, rectangular, triangular, or irregular shapes of varying size. The resistor member may be formed as a separate piece and then be vibration welded or heat staked to the body of the CRU. The resistor member may be incorporated into features of the CRU. For example, the resistor member may be made into the guide rail of a process cartridge and a corresponding contact associated with the sensor system can be located in at least one channel of the developer unit such that as the guide rail slides in the channel, contact with the sensor system is made when the process cartridge is in operational position. The resistor member may be formed and positioned as a feature on the CRU such that it is generally indistinguishable.

In embodiments, the resistor member may be permanently attached to the CRU such that it may not be removable without destroying the CRU. The resistor member may be chemically, thermally, mechanically, welded, staked, or adhesively applied to the CRU. In use, the resistor member may contact a selected conductive contact in a developer unit for further communication with an electrical circuit and sensor system.

In embodiments, the resistor member may include a resistor; plastic composite made from a polymer doped with carbon; copolymer of acrylonitrile butadiene styrene (ABS) doped with carbon; plastic, glass, or ceramic doped with carbon or metal powder or fillers; or combinations thereof. The resistor member may be of a known and fixed resistance. The resistor member may have a resistance ranging from, for example, 0 ohms to 100 megohms.

In embodiments, the CRU may include a plurality of protrusions that cooperate with corresponding plurality of apertures in a developer unit to conduct electricity to the sensor system. The connection to the sensor system can be made from leads from the resistor member or surface contacts of the resistor member through a conductive member such as a contact, leaf spring contact, conductive path compatible with the system architecture in the developer unit where the CRU is fitted for operational engagement. Optionally, a conductive spring system may be used to connect the resistor member to the sensor system.

In embodiments, the resistor member may be positioned on or about the ridges and/or valleys of the threads of a toner container and the conductive contact member may be positioned on or about the ridges and/or valleys of the threads of an opening receiving the toner container.

Figure 6:
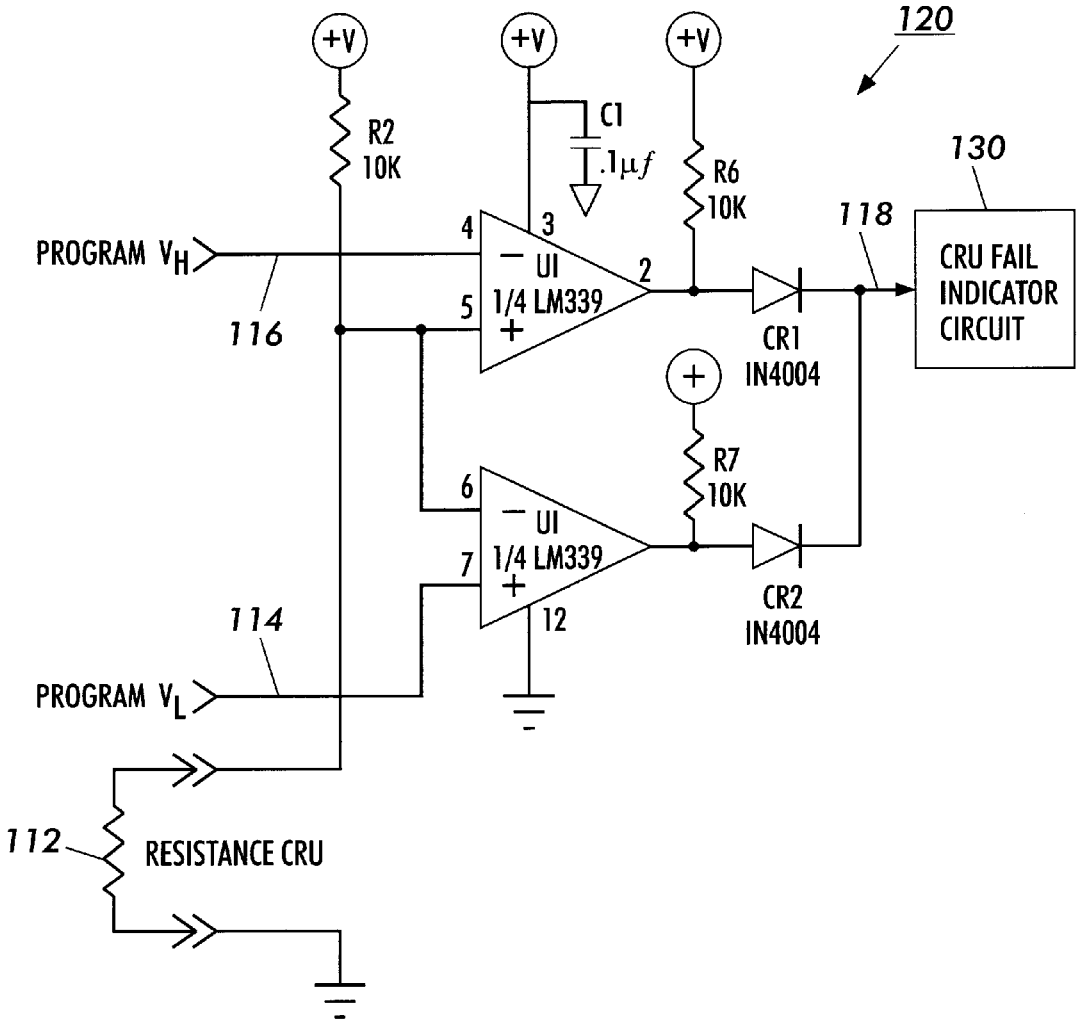
FIG. 6 is a schematic diagram of an embodiment of a window comparator circuit.
Figure 7:
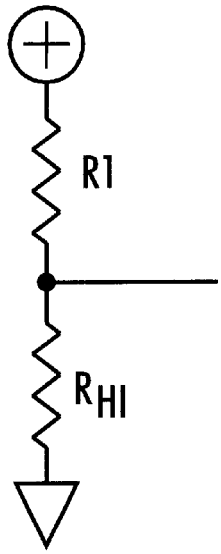
FIG. 7 is a schematic diagram of an embodiment of a program $V_H$ of the window comparator circuit.
Figure 8:
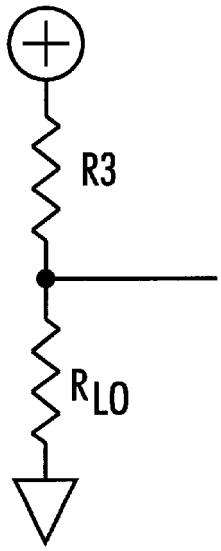
FIG. 8 is a schematic diagram of an embodiment of a program $V_L$ of the window comparator circuit.

FIG. 6 illustrates an embodiment of a window comparator circuit 120 that may be associated with a sensor system in an electrophotographic apparatus for comparing a voltage change over a resistor member on, for example, the container, bottle, process cartridge or CRU to verify its configuration. The window comparator circuit including a voltage divider network may be set or programmed to signal fault when a reading of the resistor member is outside a selected range of assigned values. In use, each type of toner bottle, process cartridge, CRU, or part may contain at least one resistor member of known resistance value. The window comparator circuit senses a voltage value based on input voltage and known resistance of the resistor member. The window comparator circuit 120 compares a resistance value or a voltage change across a resistance 112 in, for example, the machine 20. In alternate embodiment, any suitable circuit that can detect and compare resistance values or a voltage change across a resistance can be used. The resistance value 112 or voltage change measured can be compared to a theoretical value stored in the comparative circuit 120 provided by inputs $V_H$ 116 and $V_L$ 114. Inputs 114 and 116 can be programmed for each machine 20 to meet customer requirements. A pass/fail signal 118 can be sent to an indicator circuit 130. Embodiments of inputs $V_H$ 116 and $V_L$ 114 are further illustrated in FIGS. 7 and 8, respectively. The circuit will be more accurate when the values for R1, R2, and R3 are closer in value. Generally, most any resistance value will work and 10K ohms is nominal. Generally, most any rectifying diode will work for CR1 and CR2 and 1N4001 is nominal. $R_{HI}$, sets the upper limit for acceptable resistance of conductive element on CRU in the apparatus. $R_{LO}$ sets the lower limit for acceptable resistance of conductive element on CRU in the apparatus.

In operation, if a CRU of incorrect configuration is loaded into the machine, the delta voltage will not match the target range and the machine will send a fault signal to a display. The sensor system including a window comparator circuit determines whether the resistor member on the CRU is within an allowed range of resistance and thus whether the CRU being used is the proper configuration for the electrophotographic apparatus. A processor receives a go/no go signal from the window comparator circuit.

Figure 9:
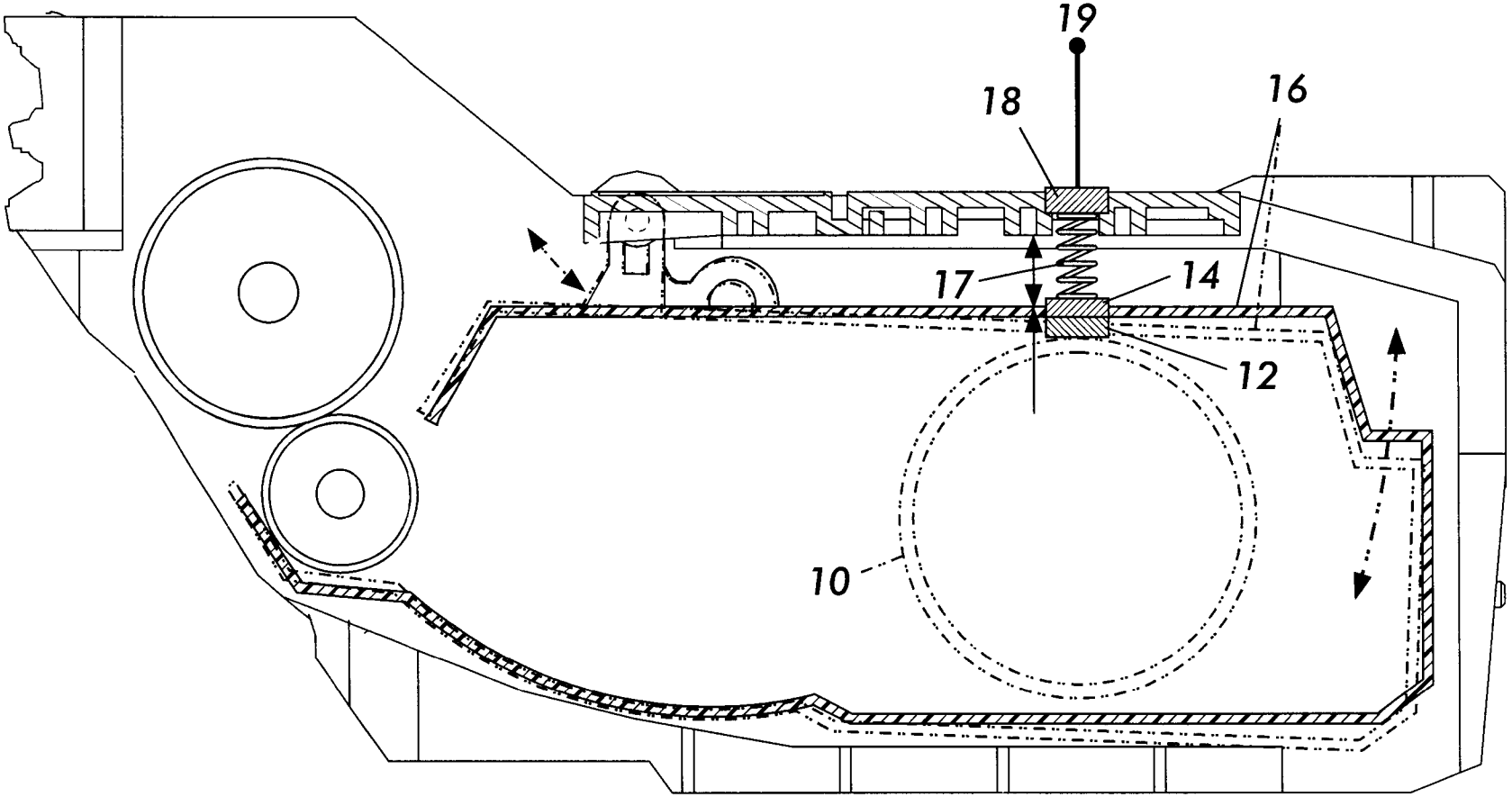
FIG. 9 is a perspective view of a toner bottle interlock system.

FIG. 9 illustrates a section of an embodiment of a process cartridge utilizing a developer roll spring (DRS) 17 to conduct electricity between a toner bottle of a CRU and the low voltage low voltage power supply (LVPS) 19. An electrical circuit is formed when the toner bottle 10 is placed in the CRU. The circuit is adapted to open or close on the 24 volt line and act as an interlock to kill the high voltage power supply (HVPS) when there is no toner bottle in the CRU or no CRU in the developer unit. In use, a contact 12 on the toner bottle makes contact with a contact 14 on the developer housing 16 which then contacts a conductive DRS 17, a contact 18 on the CRU housing and then connects to a LVPS 19.

In operation, when the contact on the toner bottle makes contact with a contact on the developer housing, a low voltage circuit is closed allowing operation of the high voltage power supply. When the toner bottle is not in place, the circuit is open and the high voltage power supply does not operate. The static condition of the DRS spring may be used to connect the conductor on the CRU and a conductor on the stationary developer housing. There is relative movement between the developer housing and the CRU housing. The DRS 17 is utilized to complete the low voltage circuit within the print cartridge. This system allows for movement between the CRU housing and developer housing without adding a separate electrical connection. When the CRU is in place with a toner bottle installed a complete low voltage circuit is made. When the CRU is not installed or the toner bottle is not in place no circuit is completed and the machine is inoperable. This system acts as a key to insure that there is a toner bottle present in the CRU before the system high voltage is enabled. Alternatively, the DRS 17 may be used to conduct electricity between the resistor member and sensor system.

In summary, the container configuration matching system may be used for configuration control to insure that a CRU of the correct configuration is used in a selected printing or copying apparatus. The system is also envisioned to be used with other customer replaceable parts in addition to containers, process cartridges, CRU's, and toner bottles.

While this invention has been described in conjunction with various embodiments, it is evident that many alternatives, modifications, and variations thereof will be apparent to those skilled in the art. Accordingly, it is intended to embrace all such alternatives, modifications, and variations and their equivalents.

What is claimed is:

1. A container for containing a supply of toner particles, comprising:

a plastic body defining a wall, an outside surface, and a chamber, the chamber for storing particles therein, the body made of a first material; and a resistor member having a length, width, thickness, and selected resistance value attached to the body, the resistor member made of a second material and being permanently attached to the body;

wherein the resistor member is made of an electrically conductive material and is made of a material different than the body;

a developer unit;

a sensor system functionally associated with the developer unit;

an electrical circuit functionally associated with the sensor system wherein the sensor system is adapted to identify the resistance of the resistor member upon electrical contact between the resistor member and the electrical circuit and wherein the sensor system is adapted to communicate a fault signal to a processor if the container is an incorrect configuration; and an electrically conductive leaf spring to conducts electricity between the container and the electrical circuit.

2. The container of claim 1, wherein the plastic body is non-conductive.

3. The container of claim 1, wherein the resistor member is attached to the outside surface of the body.

4. The container of claim 1, wherein the resistor member is embedded in the wall of the body.

5. The container of claim 1, wherein the resistor member is located internal in the body and includes contacts extending from the resistor member to the outside of the body.

6. The container of claim 1, wherein the container is a toner bottle.

7. The container of claim 1, wherein the container is a process cartridge.

8. The container of claim 7, wherein the process cartridge is fittable to a developer unit in an electrophotographic apparatus.

9. The container of claim 1, wherein the resistor member is a strip of conductive material of selected resistance.

10. The container of claim 1, wherein the sensor system is adapted to communicate a fault signal when the resistor member has a resistance value outside a selected target range.

11. The container of claim 1, wherein the sensor system is adapted for configuration identification of toner containers.

12. The container of claim 1, wherein the sensor system includes a window comparator electrical circuit including a range of allowable resistance values for comparison against the selected resistance of the resistor member on the container.

13. The container of claim 1, wherein the sensor system is adapted to send a fault signal to a selected printing or copying apparatus if the resistance in the resistor member is not within the range programmed in the window comparator circuit after the container is installed in the selected printing or copying apparatus.

14. A container for containing a supply of toner particles, comprising:

a plastic body defining a wall, an outside surface, and a chamber, the chamber for storing particles therein, the body made of a first material; and a resistor member having a length, width, thickness, and selected resistance value attached to the body, the resistor member made of a second material and being permanently attached to the body;

wherein the resistor member is made of an electrically conductive material and is made of a material different than the body;

a developer unit;

a sensor system functionally associated with the developer unit; and an electrical circuit functionally associated with the sensor system wherein the sensor system is adapted to identify the resistance of the resistor member upon electrical contact between the resistor member and the electrical circuit and wherein the sensor system is adapted to communicate a fault signal to a processor if the container is an incorrect configuration; wherein the container is a process cartridge and wherein an electrically conductive spring associated with the developer unit housing opens the electrical circuit on the voltage line when there is no toner bottle in the process cartridge and acts as an interlock to kill the high voltage power supply.

15. A container for containing a supply of toner particles, comprising:

a plastic body defining a wall, an outside surface, and a chamber, the chamber for storing particles therein, the body made of a first material; and a resistor member having a length, width, thickness, and selected resistance value attached to the body, the resistor member made of a second material and being permanently attached to the body;

wherein the resistor member is made of an electrically conductive material and is made of a material different than the body;

a developer unit;

a sensor system functionally associated with the developer unit;

an electrical circuit functionally associated with the sensor system wherein the sensor system is adapted to identify the resistance of the resistor member upon electrical contact between the resistor member and the electrical circuit and wherein the sensor system is adapted to communicate a fault signal to a processor if the container is an incorrect configuration; wherein the container is a process cartridge and wherein an electrically conductive spring associated with the developer unit housing opens the electrical circuit on the voltage line when there is no process cartridge in the developer unit and acts as an interlock to kill the high voltage power supply.

16. The container of claim 15, wherein the resistor member is in the form of a functional feature including at least one of a ridge, channel, slide rail and protrusion associated with the wall of the container.

17. An electrophotographic apparatus comprising:

a process cartridge including a wall, an outside surface, and a chamber, the chamber for storing particles therein; and a developing unit including a conductive spring member associated therewith, the spring member adapted to move from a first position when the process cartridge is operatively engaged and close an electrical circuit of a voltage line and adapted to move to a second position when the process cartridge is removed and open the electrical circuit; wherein in the second position the open electrical circuit on the voltage line eliminates the high voltage power supply to the electrophotographic apparatus wherein if the process cartridge is fitted in the developing unit, a low voltage circuit is closed utilizing a conductive connector to bridge the open circuit and wherein if the process cartridge is not fitted in the developing unit, the low voltage circuit is open causing a high voltage supply line to be open and the electrophotographic apparatus to be inoperable.

18. A method of determining the configuration of a container in a printing or copying apparatus comprising:

providing a plastic container adapted for use in a developer unit, the container defining a wall, an outside surface, and a chamber;

associating a resistor member with the plastic container, the resistor member having a length, width, thickness, and selected resistance value, the resistor member being made of an electrically conductive material;

providing a sensor system and an electrical circuit adapted to identify a resistance value of the resistor member on the container when the resistor member is functionally associated with the electrical circuit;

contacting the resistor member with the electrical circuit in conjunction with the container being functionally associated with a developer unit;

identifying the resistance of the resistor member;

communicating a fault signal when a container of incorrect configuration is associated with the developer unit, the signal being triggered based on the identified resistance of the resistor member being outside an allowed target range programmed in a window comparator circuit; and providing a conductive spring between the developer unit housing and the container; wherein if the container is fitted in the developer unit housing, a low voltage circuit is closed utilizing a conductive connector to bridge the open circuit and wherein if the container is not fitted in the developer unit housing, the low voltage circuit is open causing a high voltage supply line to be open and the printing or copying apparatus to be inoperable.

19. The method of claim 18, further comprising using the window comparator circuit to compare a programmed resistance range for a container in the printing or copying apparatus with the actual identified resistance of the resistor member on the container in the printing or copying apparatus.

20. The method of claim 18, further comprising loading the container into the printing and copying apparatus and providing a fault signal when an incorrect resistance is identified and causing a display on the printing and copying apparatus to communicate a fault signal.

* * * * *